US007318699B2

(12) United States Patent
Serafini et al.

(10) Patent No.: US 7,318,699 B2
(45) Date of Patent: Jan. 15, 2008

(54) MOISTURE REMOVAL GROOVES ON STEAM TURBINE BUCKETS AND COVERS AND METHODS OF MANUFACTURE

(75) Inventors: Joseph Mark Serafini, Schenectady, NY (US); David Alan Caruso, Ballston Lake, NY (US); Mark Edward Burnett, Buskirk, NY (US); William James Sumner, Mechanicville, NY (US)

(73) Assignee: General Electric Company, Schenectady, NY (US)

( * ) Notice: Subject to any disclaimer, the term of this patent is extended or adjusted under 35 U.S.C. 154(b) by 392 days.

(21) Appl. No.: 11/139,661

(22) Filed: May 31, 2005

(65) Prior Publication Data

US 2006/0269401 A1 Nov. 30, 2006

(51) Int. Cl.
*F03B 11/00* (2006.01)

(52) U.S. Cl. ..... 415/169.4; 415/169.1; 416/92; 416/236 R

(58) Field of Classification Search ..... 415/169.1, 415/169.2, 169.3, 169.4, 914; 416/92, 236 R
See application file for complete search history.

(56) References Cited

U.S. PATENT DOCUMENTS

| | | | | |
|---|---|---|---|---|
| 1,829,674 | A * | 10/1931 | Rosenlocher | 415/169.4 |
| 3,290,004 | A * | 12/1966 | Ishibashi | 415/169.4 |
| 3,304,056 | A * | 2/1967 | Sohma | 415/169.4 |
| 3,973,870 | A * | 8/1976 | Desai | 415/169.4 |
| 5,261,785 | A * | 11/1993 | Williams | 415/169.2 |
| 6,213,711 | B1 * | 4/2001 | Muller et al. | 415/191 |
| 6,375,417 | B1 | 4/2002 | Hofer et al. | |
| 6,474,942 | B2 | 11/2002 | Markytan | |

* cited by examiner

*Primary Examiner*—Igor Kershteyn
(74) *Attorney, Agent, or Firm*—Nixon & Vanderhye, PC

(57) ABSTRACT

Covers on bucket tips are provided with an access slot along a circumferentially facing edge of the cover at a location where moisture removal grooves of the bucket will intersect with the cover. Machine tooling is then applied to form the grooves along the suction side and adjacent the leading of the bucket. The machining runs out through the access slot forming grooves along the side edge of the bucket cover within the slot. The axial extent of the covers overlying leading and trailing edges of the buckets is maintained while enabling moisture removal by centrifugal action.

11 Claims, 2 Drawing Sheets

MOISTURE REMOVAL GROOVES ON STEAM TURBINE BUCKETS AND COVERS AND METHODS OF MANUFACTURE

The present invention relates to moisture removal grooves on covered buckets for steam turbines and particularly relates to moisture removal grooves formed along the bucket surface and continuing along the bucket cover and methods of manufacture.

BACKGROUND OF THE INVENTION

As explained in U.S. Pat. No. 5,261,785, the moisture content of the steam, particularly in the later stages of the steam turbine, reaches a level where the moisture should be removed to minimize erosion of the buckets and maintain efficiency of the turbine. One approach to the problem has been to cut back the forward or leading edge of the cover sufficiently to expose the grooves adjacent the tip of the bucket enabling the excess water to be removed from the steam path by the centrifugal action of the buckets. While cutting back the entire forward edge of the cover to permit water removal can be accomplished, the reduction in axial length of the cover negatively impacts the adequacy of the sealing at the bucket tip, i.e. the cover has stationary sealing devices, such as labyrinth brushes or seals, for sealing with stationary components of the turbine.

In the aforementioned patent, that problem is addressed by relieving the cover only at a location adjacent the entrance area of the cover where the cover would otherwise overlie the grooves formed in the bucket adjacent the leading edge. Thus, according to that patent this notched or scalloped area exposes the water removal grooves radially. With only the portion of the cover adjacent the leading edge and the grooves relieved, the balance of the cover may extend its full axial width to essentially overlie leading and trailing edges of the bucket.

While these two approaches can be effective to remove moisture, the cut back or relief in both covers still provides less axial distance to provide adequate sealing at the bucket tip using sealing devices, such as labyrinth or brush seals. One concept advantageously enables the grooves along the bucket to be run out through the tip of the bucket without interference by the cover. However, where the turbine bucket is integrally formed with the cover or when a cover is subsequently applied to the bucket tip after manufacture of the bucket, the grooves along the bucket surface cannot be run out since the bucket cover otherwise interferes with the machining of the grooves. That is, to allow a run out area for the tooling used to machine the grooves as well as to expose the grooves radially, the cover in both cases requires machining back axially or radially beyond the location of the last groove. Accordingly, there has developed a need for moisture removal grooves on integrally covered buckets or buckets having covers installed subsequent to bucket formation but prior to formation of the grooves without the cover being axially cut back or relieved.

BRIEF DESCRIPTION OF THE INVENTION

In a preferred embodiment of the present invention, there is provided a rotary component for a steam turbine, comprising a turbine bucket having opposite suction and pressure sides, a leading edge, a trailing edge and a cover carried on a tip thereof; the bucket including a plurality of grooves extending along a portion of the suction side of the bucket toward the tip and adjacent the leading edge thereof; the cover having a plurality of grooves formed along an edge thereof and in registration with the grooves extending along the suction side of the bucket enabling the bucket and cover grooves to form substantial continuations of one another.

In a further preferred embodiment of the present invention, there is provided in a steam turbine, a plurality of circumferentially spaced turbine buckets about an axis, each bucket having opposite suction and pressure sides, a leading edge, a trailing edge and a cover carried on a tip thereof; each bucket including a plurality of grooves extending along a portion of the suction side of the bucket toward the tip and adjacent the leading edge thereof; the covers having a plurality of grooves formed along an edge thereof and in registration with the grooves extending along the suction sides of respective buckets enabling the bucket and cover grooves to form substantial continuations of one another.

In a further preferred embodiment of the present invention, there is provided a method of forming moisture removal grooves in a turbine bucket having a cover comprising the steps of: (a) forming a slot along a side edge of the cover between radially inner and outer surfaces thereof; and (b) forming moisture removal grooves along a suction side of the bucket and continuing along a base of the slot formed in the cover to form grooves in the cover which exit the cover at an outer surface location remote from the bucket.

DETAILED DESCRIPTION OF THE INVENTION

Figure 1:
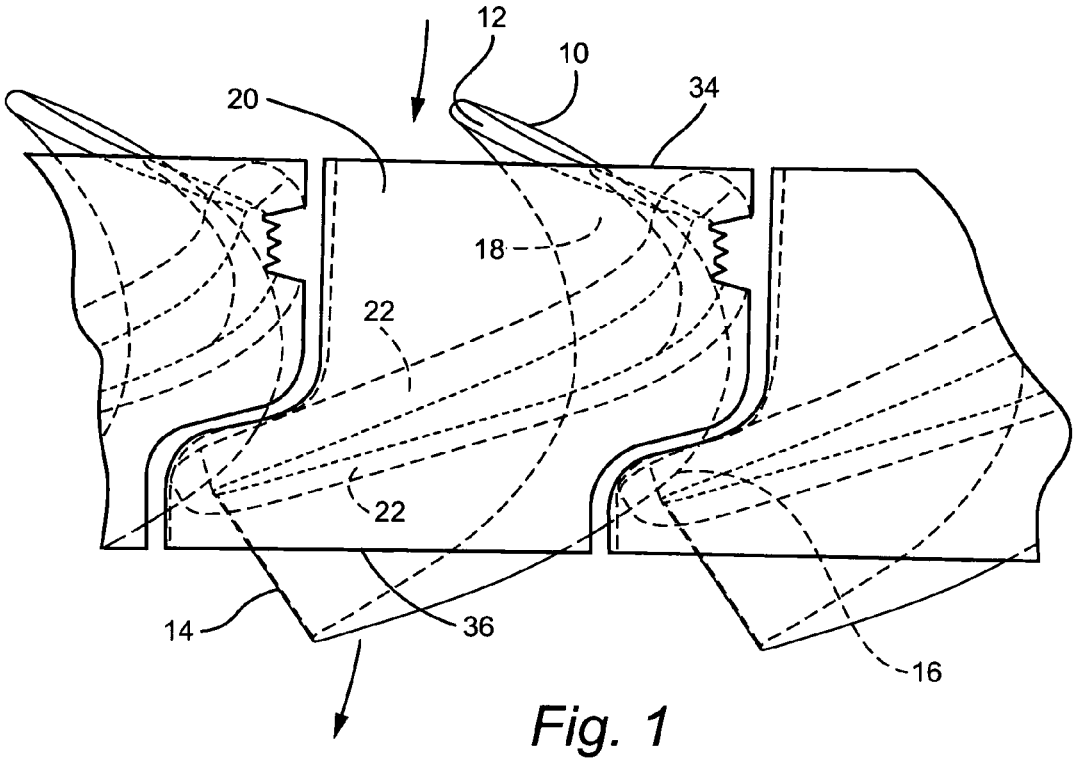
FIG. 1 is a fragmentary radial inward view of bucket covers taken from a location radially outwardly of the cover illustrating the shape of the cover, the access slot and grooves.
Figure 2:
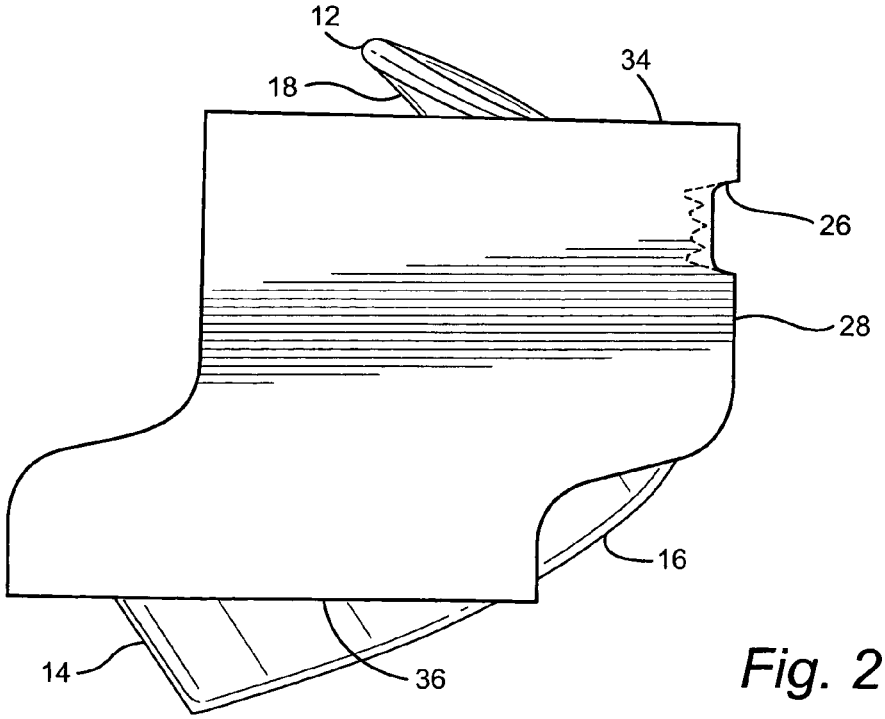
FIG. 2 is an enlarged view similar to FIG. 1 of a single bucket cover before running the grooves out along the cover.

Referring now to the drawings, particularly to FIGS. 1 and 2, there is illustrated a rotary component of a steam turbine including a bucket 10 having a leading edge 12, a trailing edge 14, a suction side 16 and a pressure side 18. Also illustrated is a cover 20 preferably formed integrally on the tip of the bucket. A fillet area 22 is also illustrated in FIG. 1 at the juncture of the bucket along the pressure and suction sides with the cover 20. It will be appreciated that a plurality of buckets 10 are arranged in circumferentially spaced relation to one another about the rotor axis of the turbine. Also, the covers 20 are in a generally Z-shaped configuration as viewed radially and are spaced one from the other in a circumferential direction.

Figure 3:
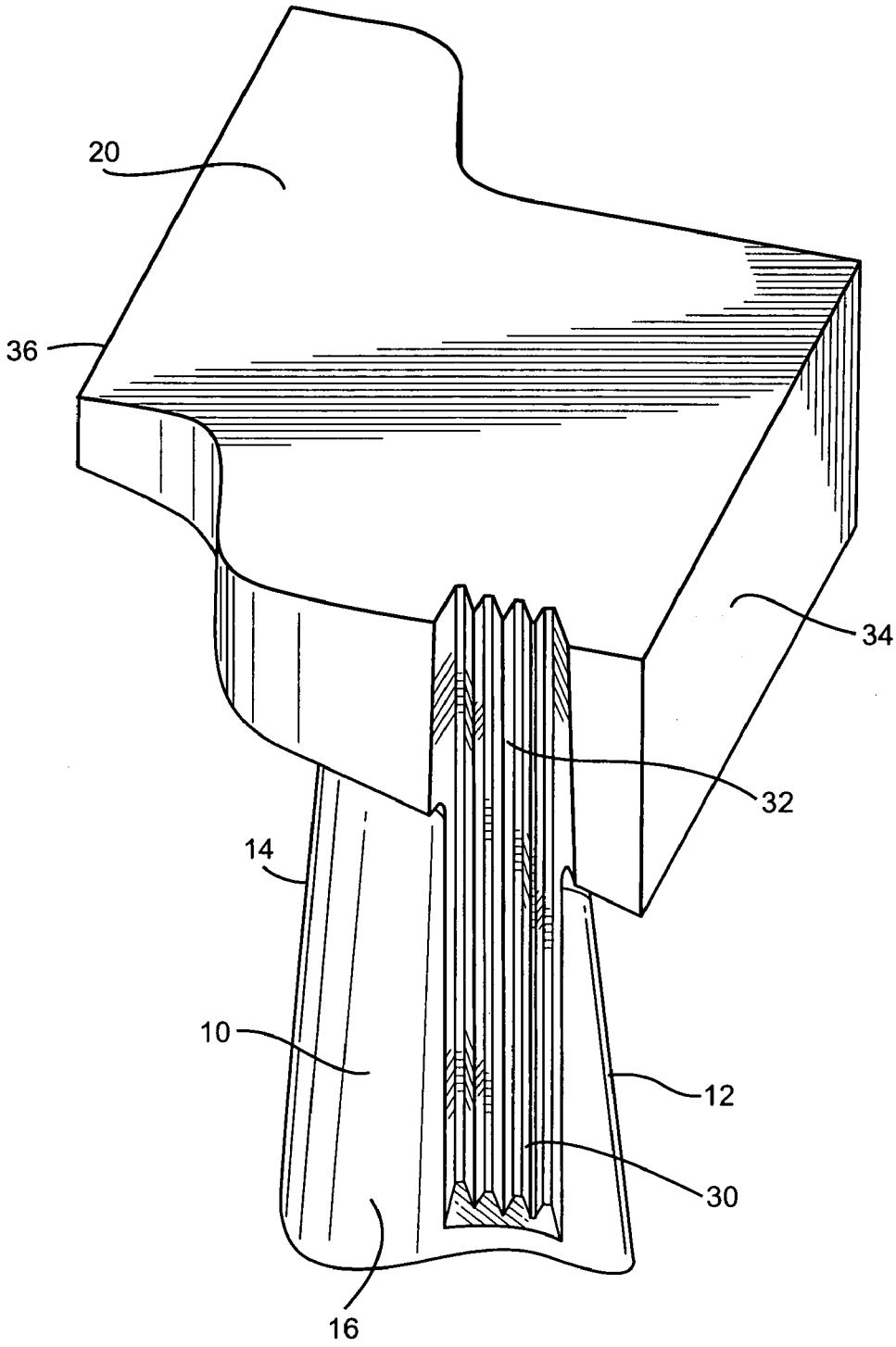
FIG. 3 is a fragmentary perspective view illustrating the continuation of the moisture removal grooves along the suction side adjacent the leading edge of the bucket and cover.

As best illustrated in FIG. 2, an access slot 26 is formed along a circumferentially facing side edge of the cover 20 at a location circumferentially adjacent to the intended juncture of grooves 30 (FIG. 3) formed along the suction side 16 of the bucket 10 adjacent the leading edge 12 and the cover. That is, the access slot 26 is formed at a location where the moisture removal grooves subsequently formed in the suction side surface of the bucket join with the cover 20. Further, the access slot 26 is formed, for example by machining, at an angle which will approximate the taper angle along the suction side surface of the bucket where the grooves will be formed. The access slot 26 enables a machinist to run the grooves 30 along the suction side surface of the bucket adjacent the leading edge and out through the cover in a continuous machining operation to form grooves 32 along the side edge of the cover. That is, as best illustrated in FIG. 3, the grooves 30 are formed subsequent to the formation of the access slot 26 in the cover 20 enabling the machining tool to run the grooves 30 continuously along the surfaces of the bucket and base of the access slot 26 of the cover thus exposing the grooves 30 and 32 in a radial direction enabling the removal of moisture by centrifugal action during operation of the turbine.

It will also be appreciated that the formation of an access slot permitting the run out of the grooves along both the bucket and cover does not require any reduction in the axial extent of the bucket cover or any relief formation in the bucket cover. That is, the forward and aft edges 34 and 36, respectively, overlie the respective leading and trailing edges 12 and 14 of the bucket. The machining operation using the access slot in the cover is particularly useful for integrally formed buckets and covers. It may also be utilized for covers otherwise secured to the buckets, e.g. by tenons extending through openings in the cover and peened. As a consequence, the covers maintain their axial extent and thus maintain their capacity, with labyrinth or brush type seals, for sealing against the adjoining fixed component of the turbine. Turbine efficiency is therefore maintained and erosion due to water damage is minimized.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary component for a steam turbine, comprising:

a turbine bucket having opposite suction and pressure sides, a leading edge, a trailing edge and a cover carried on a tip thereof;

said bucket including a plurality of grooves extending along a portion of the suction side of the bucket toward said tip and adjacent the leading edge thereof;

said cover having a plurality of grooves formed along an edge thereof and in registration with the grooves extending along the suction side of the bucket enabling the bucket and cover grooves to form substantial continuations of one another.

2. A rotary component according to claim 1 wherein said bucket and said cover are formed integral with one another.

3. A rotary component according to claim 1 wherein said cover includes a forward edge overlying the leading edge of the bucket at its juncture with the cover.

4. A rotary component according to claim 3 wherein said cover includes an aft edge overlying the trailing edge of the bucket at its juncture with the cover.

5. In a steam turbine:

a plurality of circumferentially spaced turbine buckets about an axis, each said bucket having opposite suction and pressure sides, a leading edge, a trailing edge and a cover carried on a tip thereof;

each said bucket including a plurality of grooves extending along a portion of the suction side of the bucket toward said tip and adjacent the leading edge thereof;

said covers having a plurality of grooves formed along an edge thereof and in registration with the grooves extending along the suction sides of respective buckets enabling the bucket and cover grooves to form substantial continuations of one another.

6. A steam turbine according to claim 1 wherein said bucket and cover are formed integral with one another.

7. A steam turbine according to claim 1 wherein each said cover includes a forward edge overlying the leading edge of the bucket at its junction with the cover.

8. A steam turbine according to claim 3 wherein each said cover includes an aft edge overlying the trailing edge of the bucket at its junction with the cover.

9. A method of forming moisture removal grooves in a turbine bucket having a cover comprising the steps of:

(a) forming a slot along a side edge of the cover between radially inner and outer surfaces thereof; and (b) forming moisture removal grooves along a suction side of the bucket and continuing along a base of the slot formed in the cover to form grooves in the cover which exit the cover at an outer surface location remote from the bucket.

10. A method according to claim 9 including forming the slot at an angle generally corresponding to a bucket taper angle at the moisture removal groove location along the bucket.

11. A method according to claim 9 wherein step (a) is performed prior to step (b).

* * * * *